US010003132B2

(12) United States Patent
Du et al.

(10) Patent No.: US 10,003,132 B2
(45) Date of Patent: Jun. 19, 2018

(54) SHARED-APERTURE ANTENNA AND BASE STATION

(71) Applicant: Huawei Technologies Co., Ltd., Shenzhen, Guangdong (CN)

(72) Inventors: Mingde Du, Chengdu (CN); Songlin Shuai, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 50 days.

(21) Appl. No.: 15/248,377

(22) Filed: Aug. 26, 2016

(65) Prior Publication Data

US 2016/0365647 A1 Dec. 15, 2016

Related U.S. Application Data

(63) Continuation of application No. PCT/CN2014/072634, filed on Feb. 27, 2014.

(51) Int. Cl.

| | |
|---|---|
| ***H01Q 1/38*** | (2006.01) |
| ***H01Q 21/06*** | (2006.01) |
| ***H01Q 5/30*** | (2015.01) |
| ***H01Q 1/24*** | (2006.01) |
| ***H01Q 9/04*** | (2006.01) |
| ***H01Q 21/20*** | (2006.01) |
| ***H01Q 25/00*** | (2006.01) |

(Continued)

(52) U.S. Cl.

CPC ..... *H01Q 21/065* (2013.01); *H01Q 1/246* (2013.01); *H01Q 5/30* (2015.01); *H01Q 5/371* (2015.01); *H01Q 5/42* (2015.01); *H01Q 9/0421* (2013.01); *H01Q 21/205* (2013.01); *H01Q 25/00* (2013.01)

(58) Field of Classification Search

CPC ..... H01Q 1/246; H01Q 5/42; H01Q 21/065; H01Q 5/30; H01Q 5/371; H01Q 1/38

See application file for complete search history.

(56) References Cited

U.S. PATENT DOCUMENTS

| | | | | |
|---|---|---|---|---|
| 6,025,803 A * | 2/2000 | Bergen | ..... | H01Q 1/246 343/700 MS |
| 6,597,318 B1 * | 7/2003 | Parsche | ..... | H01Q 1/36 343/700 MS |

(Continued)

FOREIGN PATENT DOCUMENTS

| | | |
|---|---|---|
| CN | 102231456 A | 11/2011 |
| CN | 102437425 A | 5/2012 |

(Continued)

*Primary Examiner* — Hoang Nguyen

(57) ABSTRACT

The present application relates to the field of antenna technologies, and discloses a shared-aperture antenna and a base station, to resolve a problem of sharing an aperture between antenna arrays working in different frequency bands. The shared-aperture antenna includes a dielectric substrate, a microstrip antenna array, and an electrically small antenna array, where the microstrip antenna array includes rows of microstrip patch antenna units uniformly distributed in arrays, and the microstrip patch antenna units fit a surface of the dielectric substrate; the electrically small antenna array includes electrically small antenna units that are parallel to each other; and the electrically small antenna units are inserted at intervals between the microstrip patch antenna units, and fit the surface of the dielectric substrate.

15 Claims, 7 Drawing Sheets

(51) Int. Cl.
*H01Q 5/371* (2015.01)
*H01Q 5/42* (2015.01)

(56) References Cited

U.S. PATENT DOCUMENTS

| | | | | |
|---|---|---|---|---|
| 6,731,241 | B2 | 5/2004 | Park et al. | |
| 6,795,020 | B2 * | 9/2004 | Sreenivas | H01Q 1/38 343/700 MS |
| 2009/0021437 | A1 * | 1/2009 | Foo | H01Q 1/2291 343/761 |
| 2010/0066590 | A1 * | 3/2010 | Brown | G01S 7/03 342/147 |

FOREIGN PATENT DOCUMENTS

| | | | |
|---|---|---|---|
| CN | 102760942 | A | 10/2012 |
| CN | 103259087 | A | 8/2013 |
| CN | 103296410 | A | 9/2013 |
| CN | 103337713 | A | 10/2013 |
| CN | 103441332 | A | 12/2013 |
| CN | 103606745 | A | 2/2014 |

* cited by examiner

SHARED-APERTURE ANTENNA AND BASE STATION

CROSS-REFERENCE TO RELATED APPLICATIONS

This application is a continuation of International Application No. PCT/CN2014/072634, filed on Feb. 27, 2014, which is hereby incorporated by reference in its entirety.

TECHNICAL FIELD

The present application relates to the field of antenna technologies, and in particular, to a shared-aperture antenna and a base station.

BACKGROUND

With rapid development of wireless communications, a set of communications system needs to be capable of radiating and receiving multiple bands, so that an antenna matching the communications system needs to radiate and receive the multiple different bands. However, in a lot of communications devices, because of a requirement on integration and miniaturization of the communications devices, there is no sufficient space allocated to antennas of two or more different bands.

To implement integrated design of antennas of different bands in limited space, the antennas of the different bands need to be designed in a same aperture, implementing aperture sharing. A shared-aperture double-frequency or multi-frequency antenna also satisfies requirements of reducing device costs, improving device integration, and promoting intelligent antenna integration. In the prior art, FIG. 1 shows that orthogonal slot antenna arrays are used to implement aperture sharing between slot antenna arrays working in a same frequency band and having different polarization manners. However, this solution does not resolve a problem of sharing an aperture between antenna arrays working in different bands. FIG. 2 shows that multiband microstrip patch antenna arrays and multiband slot antenna arrays are used to implement aperture sharing between antenna arrays working indifferent frequency bands. However, in this solution, only microstrip patch antennas of different bands are processed and designed on a same printed circuit board, and real aperture sharing is not implemented.

SUMMARY

Embodiments of the present application provide a shared-aperture antenna and a base station, to resolve a problem of sharing an aperture between antenna arrays working in different frequency bands.

To achieve the foregoing objective, the following technical solutions are adopted in the embodiments of the present application:

According to a first aspect, an embodiment of the present application provides a shared-aperture antenna, including: a dielectric substrate, a microstrip antenna array, and an electrically small antenna array, where the microstrip antenna array includes rows of microstrip patch antenna units uniformly distributed in arrays, and the microstrip patch antenna units fit a surface of the dielectric substrate; and the electrically small antenna array includes electrically small antenna units that are parallel to each other, and the electrically small antenna units are inserted at intervals between the microstrip patch antenna units, and fit the surface of the dielectric substrate.

Ina first possible implementation manner of the first aspect, two neighboring rows of electrically small antenna units are spaced by at least one row of microstrip patch antenna units, or a quantity of rows of microstrip patch antenna units by which two or more rows of electrically small antenna units are spaced is set according to a frequency multiplication ratio.

In a second possible implementation manner of the first aspect, the electrically small antenna unit is a double-frequency or multi-frequency electrically small antenna.

In the second possible implementation manner of the first aspect, a third possible implementation manner of the first aspect is further provided, a resonance frequency generated by the electrically small antenna unit is the same as a resonance frequency generated by the microstrip patch antenna unit.

In the second possible implementation manner of the first aspect or the third possible implementation manner of the first aspect, a fourth possible implementation manner of the first aspect is further provided, feeding networks of the microstrip patch antenna unit and the electrically small antenna unit in a same resonance frequency band are related, and feeding networks of the microstrip patch antenna unit and the electrically small antenna unit in different resonance frequency bands are not related.

In a fifth possible implementation manner of the first aspect, polarization directions of the microstrip patch antenna unit and the electrically small antenna unit are the same or orthogonal.

In a sixth possible implementation manner of the first aspect, at least one metamaterial dielectric layer is added on a shared-aperture array of the microstrip antenna array and the electrically small antenna array.

According to a second aspect, an embodiment of the present application provides a base station, including: a signal processing device and the shared-aperture antenna in the first aspect and any possible implementation manner of the first aspect, where the shared-aperture antenna is configured to transmit and receive a wireless signal; and the signal processing device is configured to receive and process the wireless signal received by the shared-aperture antenna, and transmit the processed signal by using the shared-aperture antenna.

The embodiments of the present application provide a shared-aperture antenna and a base station, where the shared-aperture antenna includes a dielectric substrate, a microstrip antenna array, and an electrically small antenna array, where the microstrip antenna array includes rows of microstrip patch antenna units uniformly distributed in arrays, and the microstrip patch antenna units fit a surface of the dielectric substrate; the electrically small antenna array includes electrically small antenna units that are parallel to each other; and the electrically small antenna units are inserted at intervals between the microstrip patch antenna units, and fit the surface of the dielectric substrate, to resolve a problem of sharing an aperture between antenna arrays working in different frequency bands.

BRIEF DESCRIPTION OF THE DRAWINGS

To describe the technical solutions in the embodiments of the present application more clearly, the following briefly introduces the accompanying drawings required for describing the embodiments or the prior art. Apparently, the accompanying drawings in the following description show merely some embodiments of the present application, and persons of ordinary skill in the art may still derive other drawings from these accompanying drawings without creative efforts.

DETAILED DESCRIPTION

The following clearly describes the technical solutions in the embodiments of the present application with reference to the accompanying drawings in the embodiments of the present application. Apparently, the described embodiments are merely some but not all of the embodiments of the present application. All other embodiments obtained by persons of ordinary skill in the art based on the embodiments of the present application without creative efforts shall fall within the protection scope of the present application.

Embodiment 1

Figure 1:
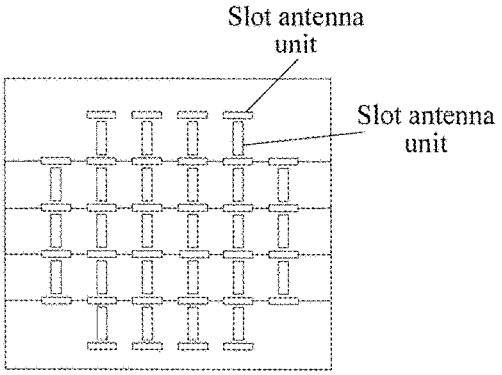
FIG. 1 is a schematic diagram of aperture sharing between heteropolar slot antennas according to the prior art.
Figure 2:
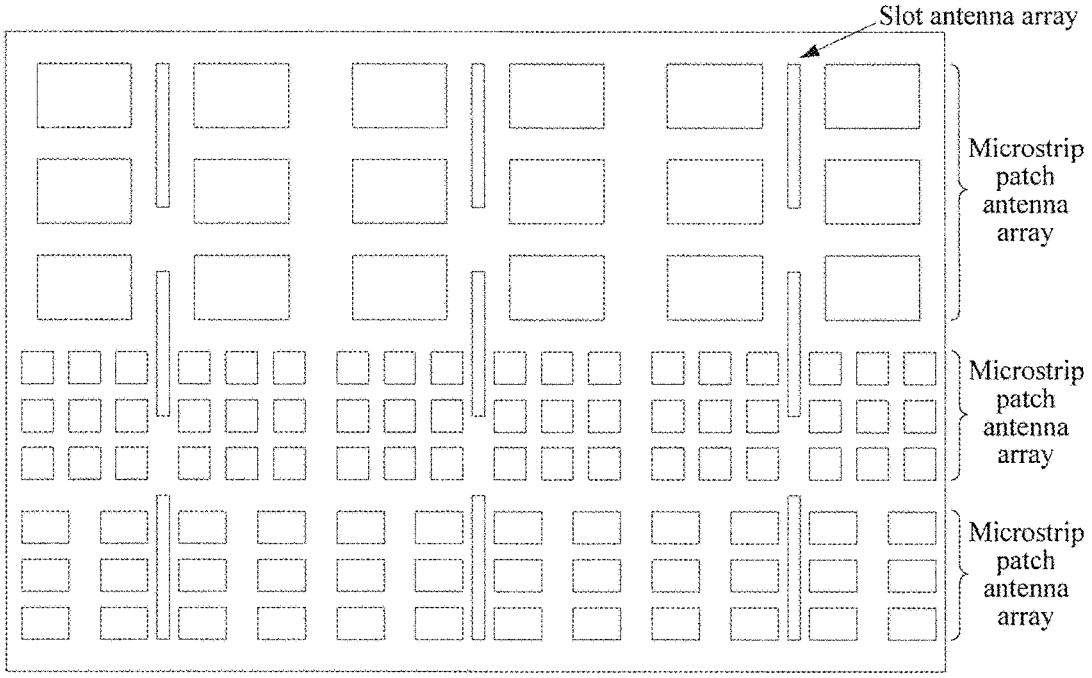
FIG. 2 is a schematic diagram of aperture sharing between microstrip patch antennas and slot antennas according to the prior art.
Figure 3:
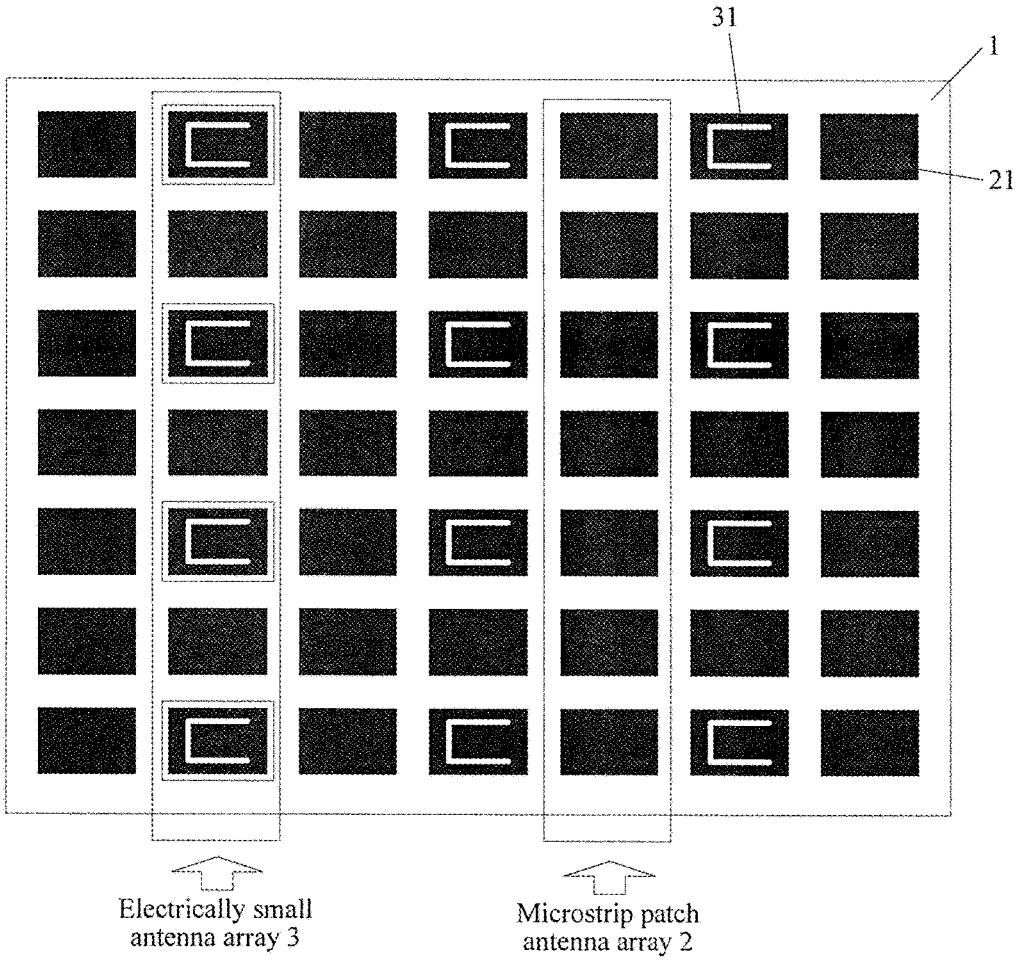
FIG. 3 is a schematic diagram of a shared-aperture antenna according to an embodiment of the present application.

An embodiment of the present application provides a shared-aperture antenna. As shown in FIG. 3, the shared-aperture antenna includes: a dielectric substrate 1, a microstrip antenna array 2, and an electrically small antenna array 3, wherein:

the microstrip antenna array 2 includes rows of microstrip patch antenna units 21 uniformly distributed in arrays, and the microstrip patch antenna units 21 fit a surface of the dielectric substrate 1; and the electrically small antenna array 3 includes electrically small antenna units 31 that are parallel to each other, and the electrically small antenna units 31 are inserted at intervals between the microstrip patch antenna units 21, and fit the surface of the dielectric substrate 1.

A part shown in black in FIG. 3 is the microstrip patch antenna unit 21, and a part shown in black and having a U-shaped slot is the electrically small antenna unit 31.

Figure 4:
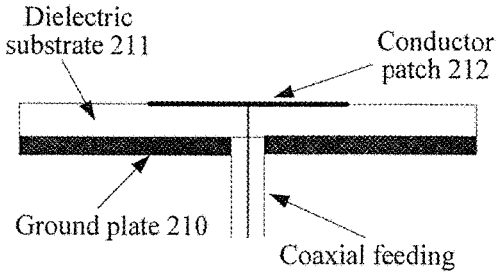
FIG. 4 is a schematic side view of a microstrip patch antenna according to the prior art.

Specifically, as shown in FIG. 4, the microstrip patch antenna unit 21 generally includes a ground plate 210, a dielectric substrate 211, and a conductor patch 212, and a feeding manner, such as a microstrip line or a coaxial line is used, a radio frequency electromagnetic field caused by excitation exists between the conductor patch 212 and the ground plate 210, and radiation is performed by using a gap between periphery of the conductor patch and the ground plate, where a shape of the conductor patch 212 may be any geometrical shape, for example, a rectangle, a circle, or a triangle.

Figure 5:
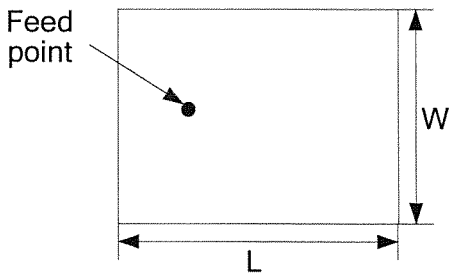
FIG. 5 is a schematic top view of a microstrip patch antenna according to the prior art.

Exemplarily, a rectangular microstrip patch antenna unit is used as an example for description. As shown in FIG. 5, a length of a rectangular microstrip patch antenna conductor patch is L, a width is W, and a resonance frequency $f_1$ of the rectangular microstrip patch antenna unit may be approximately represented as:

$$f_1 \cong \frac{c}{2\sqrt{\varepsilon_r}\,(L+W)},$$

where c is the speed of light, $\in_r$ is a relative permittivity of a dielectric substrate, L is the length of the rectangular microstrip patch antenna conductor patch, and W is the width of the rectangular microstrip patch antenna conductor patch.

Further, it may be acquired from the foregoing formula that a sum of the length and the width of the microstrip patch antenna conductor patch is approximately equal to $\lambda_1 2$, so that the resonance frequency $f_1$ of the microstrip patch antenna unit is directly proportional to $\lambda_1/2$, where $\lambda_1$ is a wavelength corresponding to the resonance frequency $f_1$ generated by the microstrip patch antenna.

Figure 6:
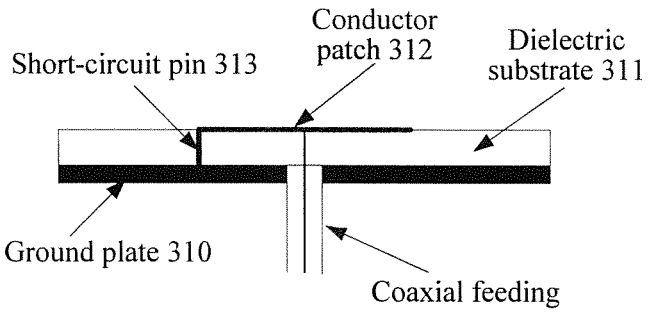
FIG. 6 is a schematic side view of an electrically small antenna according to the prior art.

As shown in FIG. 6, in this embodiment of the present application, description is made by using an example in which the electrically small antenna unit 31 is a PIFA antenna. The PIFA antenna generally includes a ground plate 310, a dielectric substrate 311, a conductor patch 312, and a short-circuit pin 313. The conductor patch 312 (or referred to as a planar radiating unit) is used as a radiator, the ground plate 310 is used as a reflection surface, a coaxial feeding manner is used, and a radiofrequency electromagnetic field caused by excitation exists between the conductor patch 312 and the ground plate 310. An electric field of the PIFA antenna is mainly concentrated on an edge of the conductor patch 312, and therefore a radiation field of the PIFA antenna is an edge radiation field, which is similar to that of the microstrip patch antenna unit 21. Therefore, to some extent, the PIFA antenna is similar to the microstrip patch antenna unit 21, but a short-circuit pin is loaded on the microstrip patch antenna unit 21. Because of an effect of the short-circuit pin, compared with a resonance length of the microstrip patch antenna unit 21, a resonance length of the PIFA antenna is decreased to $\lambda_2/4$, where $\lambda_2$ is a wavelength corresponding to a resonance frequency $f_2$ generated by the PIFA antenna.

Exemplarily, assuming that the conductor patch 312 is a rectangular radiator, a length of the rectangular radiator is A, and a width is B, the resonance frequency $f_2$ of the PIFA antenna may be approximately represented as:

$$f_2 \cong \frac{c}{4\sqrt{\varepsilon_r}\,(A+B)},$$

where c is the speed of light, $\in_r$ is a relative permittivity of the dielectric substrate, A is the length of the PIFA antenna conductor patch, and B is the width of the PIFA antenna conductor patch.

Further, it may be acquired from the foregoing formula that a sum of the length A and the width B of the PIFA antenna conductor patch is approximately equal to $\lambda_2/4$, so that the resonance frequency $f_2$ of the PIFA antenna is directly proportional to $\lambda_2/4$.

Optionally, two neighboring rows of electrically small antenna units 31 are spaced by at least one row of microstrip patch antenna units 21, or a quantity of rows of microstrip patch antenna units 21 by which two or more rows of electrically small antenna units 31 are spaced is set according to a frequency multiplication ratio.

Figure 7:
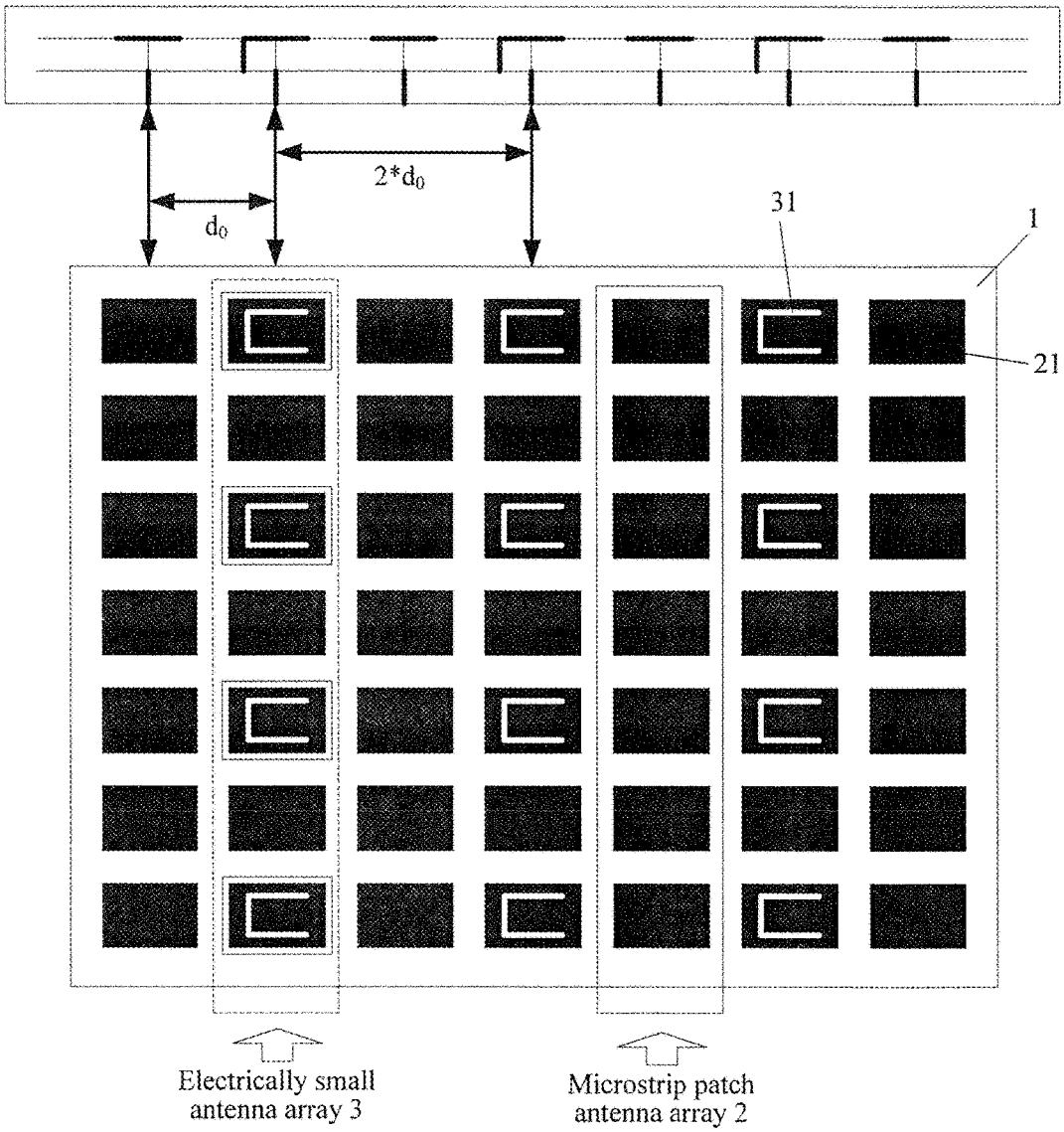
FIG. 7 is a schematic diagram of an antenna spacing of a shared-aperture antenna according to an embodiment of the present application.

Exemplarily, as shown in FIG. 7, if two neighboring rows of electrically small antenna units 31 are spaced by one row of microstrip patch antenna units 21, and a distance between two neighboring rows of microstrip patch antenna units 21 is $d_0$, a distance between the two neighboring rows of electrically small antenna units 31 is $2*d_0$.

Optionally, the electrically small antenna unit 31 is a double-frequency or multi-frequency electrically small antenna.

The PIFA antenna may work in multiple frequency bands by using double feed points, or by using a slotting technology on the PIFA antenna. When the double feed points are used, a resonance range of a resonance frequency generated by the PIFA antenna is generally limited. Therefore, the PIFA antenna working in multiple frequency bands is mostly implemented using a slotting manner, and a commonly used slotting manner includes: L-shaped slotting and U-shaped slotting.

Figure 8:
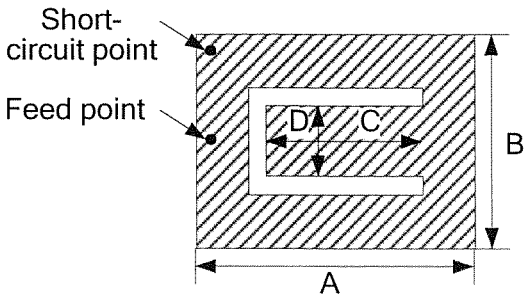
FIG. 8 is a schematic top view of a PIFA antenna having a U-shaped slot according to the prior art.

Exemplarily, as shown in FIG. 8, a PIFA antenna for which the U-shaped slotting is used is described, where a part shown in white is the U-shaped slot, apart shown by oblique lines is the PIFA antenna for which the U-shaped slotting is used, A is a length of the conductor patch, B is a width of the FIFA antenna conductor patch, C is a length of an inner radiator, and D is a width of the inner radiator. In the U-shaped slotting manner, a resonance frequency of a relatively low working frequency band may be approximately represented as:

$$f(\text{low}) \cong \frac{c}{4\sqrt{\varepsilon_r}\,(A+B)},$$

and a resonance frequency of a relatively high working frequency band may be approximately represented as:

$$f(\text{high}) \cong \frac{c}{4\sqrt{\varepsilon_r}\,(C+D)}.$$

Therefore, it may be seen that, the PIFA antenna for which the U-shaped slotting is used may generate different resonance frequencies.

Optionally, a resonance frequency generated by the electrically small antenna unit 31 is the same as a resonance frequency generated by the microstrip patch antenna unit 21.

Specifically, when the electrically small antenna unit 31 is the double-frequency or multi-frequency electrically small antenna, a relatively high resonance frequency generated by the electrically small antenna unit 31 is the same as the resonance frequency generated by the microstrip patch antenna unit 21.

Optionally, feeding networks of the microstrip patch antenna unit 21 and the electrically small antenna unit 31 in a same resonance frequency band are related, and feeding networks of the microstrip patch antenna unit 21 and the electrically small antenna unit 31 in different resonance frequency bands are not related.

When resonance frequency bands generated by the microstrip patch antenna unit 21 and the electrically small antenna unit 31 are the same, the microstrip patch antenna unit 21 and the electrically small antenna unit 31 may use a same feeding network. When resonance frequency bands generated by the microstrip patch antenna unit 21 and the electrically small antenna unit 31 are different, the microstrip patch antenna unit 21 and the electrically small antenna unit 31 use respective different feeding networks.

Optionally, polarization directions of the microstrip patch antenna unit 21 and the electrically small antenna unit 31 are the same or orthogonal.

A polarization direction of the antenna includes horizontal polarization, vertical polarization, and the like. The polarization direction of the PIFA antenna 31 for which the U-shaped slotting is used (the electrically small antenna unit 31) shown in FIG. 8 is the horizontal polarization, and the polarization direction of the microstrip patch antenna unit 21 is also the horizontal polarization. Therefore, the polarization directions of the microstrip patch antenna unit 21 and the electrically small antenna unit 31 are the same. If an opening of the U-shaped slot in the PIFA antenna 31, shown in FIG. 8, for which the U-shaped slotting is used is upward, the polarization direction of the PIFA antenna 31 of which the opening of the U-shaped slot is upward is the vertical polarization, and the polarization direction of the microstrip patch antenna unit 21 is the horizontal polarization. Therefore, the polarization directions of the microstrip patch antenna unit 21 and the electrically small antenna unit 31 are orthogonal.

Optionally, at least one metamaterial dielectric layer is added on a shared-aperture array of the microstrip antenna array 2 and the electrically small antenna array 3.

Specifically, one or more layers of metamaterial are designed and added in a broadside direction of the shared-aperture array of the microstrip patch antenna unit 21 and the electrically small antenna unit 31. In this case, with an increase in a quantity of the metamaterial dielectric layers, a gain of the microstrip patch antenna unit 21 and the electrically small antenna unit 31 approaches a limit value of a gain of a planar array, and the limit value of the gain of the planar array is:

$$G = 4\pi\frac{A}{\lambda^2},$$

where A is an area of a physical aperture at which the microstrip patch antenna unit 21 and the electrically small antenna unit 31 are located, and $\lambda$ is a wavelength corresponding to the same resonance frequency generated by the microstrip patch antenna unit 21 and the electrically small antenna unit 31.

Figure 9:
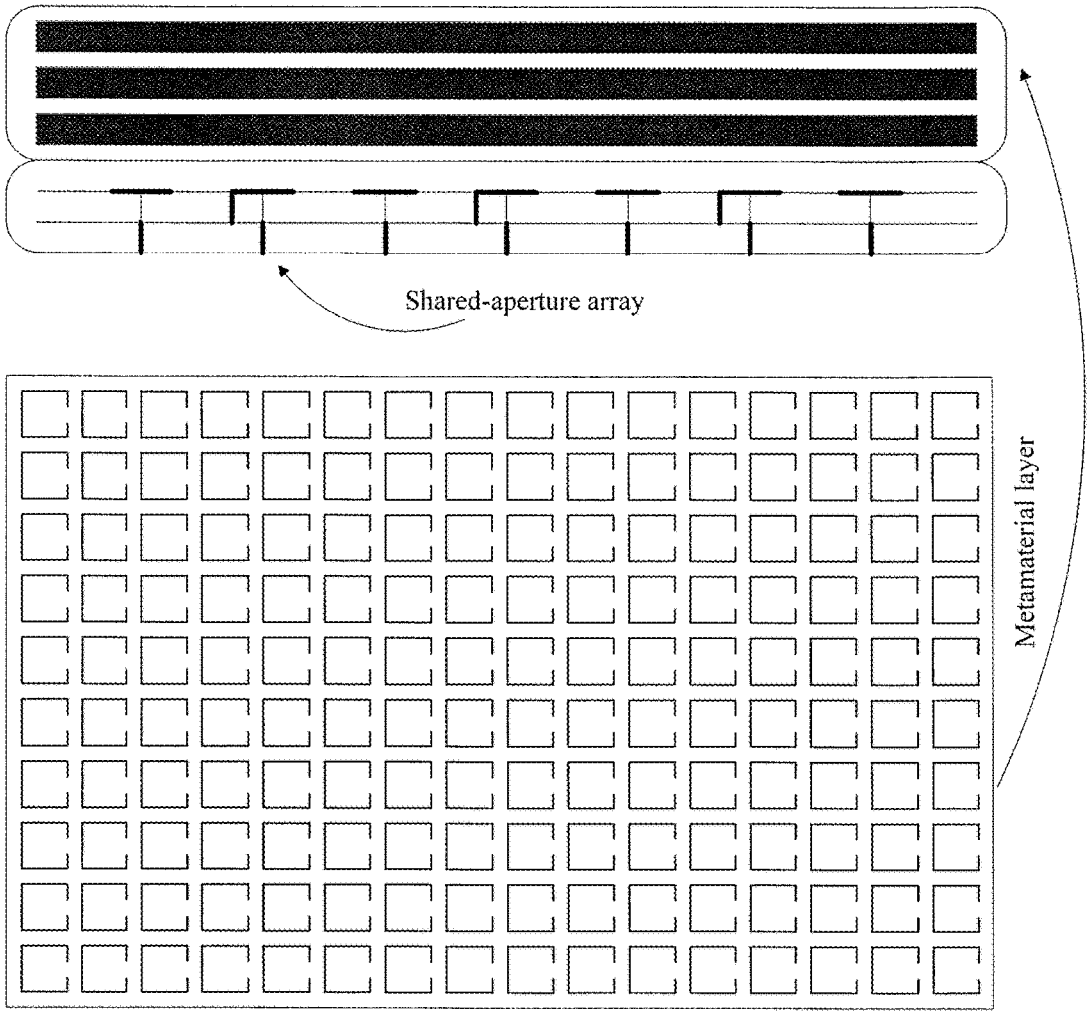
FIG. 9 is a schematic diagram of integrated design of a shared-aperture antenna and a metamaterial dielectric layer according to an embodiment of the present application.

That is, in a case in which physical apertures are the same, gains of the microstrip patch antenna unit 21 and the electrically small antenna unit 31 are consistent in a same resonance band, and unit factors are equal, to implement maximization of a gain aperture of different antenna units in a same band, and lower an effect of different unit factors on an array, where the unit factors are characteristics of antenna units included in an array antenna, for example, a beam width, a minor level, a gain, and a front-to-back ratio. Exemplarily, FIG. 9 are a top view and a side view in which three layers of metamaterial are designed and added in the broadside direction of the shared-aperture array of the microstrip patch antenna unit 21 and the electrically small antenna unit 31.

It should be noted that, the microstrip antenna array 2 and the electrically small antenna array 3 in the antenna in this embodiment of the present application are located in a same plane, so that shared-aperture arrays that are located in the same plane are not obstructed by each other, which does not affect radiation efficiency of different antenna arrays.

This embodiment of the present application provides a shared-aperture antenna, including a dielectric substrate, a microstrip antenna array, and an electrically small antenna array, where the microstrip antenna array includes rows of microstrip patch antenna units uniformly distributed in arrays, and the microstrip patch antenna units fit a surface of the dielectric substrate; the electrically small antenna array includes electrically small antenna units that are parallel to each other; and the electrically small antenna units are inserted at intervals between the microstrip patch antenna units, and fit the surface of the dielectric substrate, to resolve a problem of sharing an aperture between antenna arrays working in different frequency bands. Further, a metamaterial dielectric layer is loaded in a broadside direction of an array, implementing maximization of a gain aperture of different antenna units, and lowering an effect of different unit factors on an array.

Embodiment 2

An embodiment of the present application provides a base station, where the base station includes: a signal processing device and a shared-aperture antenna, where the shared-aperture antenna is configured to transmit and receive a wireless signal; and the signal processing device is configured to receive and process the wireless signal received by the shared-aperture antenna, and transmit the processed signal by using the shared-aperture antenna.

Specifically, as shown in FIG. 3, the shared-aperture antenna includes a dielectric substrate 1, a microstrip antenna array 2, and an electrically small antenna array 3, where the microstrip antenna array 2 includes rows of microstrip patch antenna units 21 uniformly distributed in arrays, and the microstrip patch antenna units 21 fit a surface of the dielectric substrate 1. The electrically small antenna array 3 includes electrically small antenna units 31 that are parallel to each other; and the electrically small antenna units 31 are inserted at intervals between the microstrip patch antenna units 21, and fit the surface of the dielectric substrate 1. A part shown in black in FIG. 3 is the microstrip patch antenna unit 21, and a part shown in black and having a U-shaped slot is the electrically small antenna unit 31.

The antenna in this embodiment may also include any shared-aperture antenna structure described in Embodiment 1. For details, refer to the antenna described in Embodiment 1, and details are not described herein again.

Figure 10:
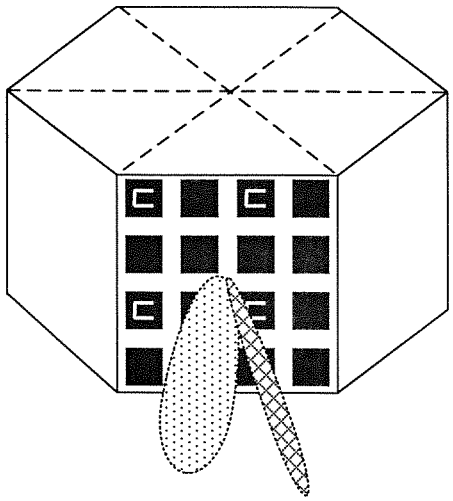
FIG. 10 is a schematic diagram of an application of a shared-aperture antenna according to an embodiment of the present application in a base station.

Exemplarily, FIG. 10 shows an application of a shared-aperture antenna according to an embodiment of the present application in a base station, and FIG. 10 represents a schematic diagram of a hexahedral base station. Three intersecting dashed lines divide the base station into six sectors, FIG. 10 shows only a schematic diagram of arrangement of a shared-aperture antenna of a sector of the sectors that directly faces, and the shared-aperture antenna in this embodiment is used as the shared-aperture antenna, and five other sectors have the same antenna configuration (not drawn in FIG. 10) as that of the sector that directly faces. A part shown in black represents the microstrip patch antenna unit 21, and a part shown in black and having a U-shaped slot is the electrically small antenna unit 31. The shared-aperture antenna can generate beams of two different frequency bands, a part shown by points represents a relatively narrow generated beam, and a part shown by double oblique lines represents a relatively broad generated beam. Certainly, the shared-aperture antenna may also generate multiple beams in a same band. If the electrically small antenna unit generates two resonance frequency bands, the double-frequency-band electrically small antenna of a relatively low resonance frequency band constitutes an antenna array of a relatively low frequency band, and the microstrip patch antenna and the double-frequency-band electrically small antenna of a relatively high frequency band constitute an antenna array of a relatively high frequency band, so that the base station implements coverage of double frequency bands (or multiple frequency bands) without increasing an antenna aperture.

Certainly, in addition to the base station of the present application, the shared-aperture antenna may also be applied to a system, such as a 5G high-frequency transceiver system, or a distributed base station, or a distributed antenna system.

This embodiment of the present application provides a base station, where the base station includes a signal processing device and a shared-aperture antenna, where the shared-aperture antenna is configured to transmit and receive a wireless signal, and includes a dielectric substrate, a microstrip antenna array, and an electrically small antenna array, where the microstrip antenna array includes rows of microstrip patch antenna units uniformly distributed in arrays, and the microstrip patch antenna units fit a surface of the dielectric substrate; the electrically small antenna array includes electrically small antenna units that are parallel to each other; the electrically small antenna units are inserted at intervals between the microstrip patch antenna units, and fit the surface of the dielectric substrate; and the signal processing device is configured to receive and process the wireless signal received by the shared-aperture antenna, and transmit the processed signal by using the shared-aperture antenna, to resolve a problem of sharing an aperture between antenna arrays working in different frequency bands.

Finally, it should be noted that the foregoing embodiments are merely intended for describing the technical solutions of the present application but not for limiting the present application. Although the present application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present application.

What is claimed is:

1. A shared-aperture antenna, comprising:

a microstrip antenna array comprising rows of microstrip patch antenna units uniformly distributed in arrays, wherein the microstrip patch antenna units are configured to fit a surface of a dielectric substrate;

a second antenna array comprising antenna units that are parallel to each other, wherein the second antenna array antenna units are disposed at intervals between the microstrip patch antenna units and configured to fit the surface of the dielectric substrate; and wherein each of the second antenna array antenna units comprises a double-frequency antenna.

2. The shared-aperture antenna according to claim 1, wherein:

two neighboring rows of the second antenna array antenna units are spaced by at least one row of the microstrip patch antenna units; or a quantity of rows of the microstrip patch antenna units by which two or more rows of the second antenna array antenna units are spaced is set according to a frequency multiplication ratio.

3. The shared-aperture antenna according to claim 1, wherein a resonance frequency generated by one or more of the second antenna array antenna units is the same as a resonance frequency generated by one or more of the microstrip patch antenna units.

4. The shared-aperture antenna according to claim 3, wherein:

feeding networks of one or more of the microstrip patch antenna units and one or more of the second antenna array antenna units in a same resonance frequency band are related; and feeding networks of one or more of the microstrip patch antenna units and one or more of the second antenna array antenna units in different resonance frequency bands are not related.

5. The shared-aperture antenna according to claim 1, wherein:

feeding networks of one or more of the microstrip patch antenna units and one or more of the second antenna array antenna units in a same resonance frequency band are related; and feeding networks of one or more of the microstrip patch antenna units and one or more of the second antenna array antenna units in different resonance frequency bands are not related.

6. The shared-aperture antenna according to claim 1, wherein polarization directions of one or more of the microstrip patch antenna units and one or more of the second antenna array antenna unit are the same or orthogonal.

7. The shared-aperture antenna according to claim 1, wherein at least one metamaterial dielectric layer is added on a shared-aperture array of the microstrip antenna array and the second antenna array.

8. A base station, comprising:

a shared-aperture antenna configured to transmit and receive a wireless signal, the shared-aperture antenna comprising, a microstrip antenna array comprising rows of microstrip patch antenna units uniformly distributed in arrays, wherein the microstrip patch antenna units are configured to fit a surface of a dielectric substrate, and a second antenna array comprising antenna units that are parallel to each other, wherein the second antenna array antenna units are disposed at intervals between the microstrip patch antenna units and configured to fit the surface of the dielectric substrate, wherein each of the second antenna array antenna units comprises a double-frequency antenna or a multi-frequency antenna; and a signal processing device configured to receive and process the wireless signal received by the shared-aperture antenna, and transmit the processed signal by using the shared-aperture antenna.

9. A shared-aperture antenna, comprising:

a microstrip antenna array comprising rows of microstrip patch antenna units uniformly distributed in arrays, wherein the microstrip patch antenna units are configured to fit a surface of a dielectric substrate;

a second antenna array comprising antenna units that are parallel to each other, wherein the second antenna array antenna units are disposed at intervals between the microstrip patch antenna units and configured to fit the surface of the dielectric substrate; and wherein each of the second antenna array antenna units comprises a multi-frequency antenna.

10. The shared-aperture antenna according to claim 9, wherein:

two neighboring rows of the second antenna array antenna units are spaced by at least one row of the microstrip patch antenna units; or a quantity of rows of the microstrip patch antenna units by which two or more rows of the second antenna array antenna units are spaced is set according to a frequency multiplication ratio.

11. The shared-aperture antenna according to claim 9, wherein a resonance frequency generated by one or more of the second antenna array antenna units is the same as a resonance frequency generated by one or more of the microstrip patch antenna units.

12. The shared-aperture antenna according to claim 11, wherein:

feeding networks of one or more of the microstrip patch antenna units and one or more of the second antenna array antenna units in a same resonance frequency band are related; and feeding networks of one or more of the microstrip patch antenna units and one or more of the second antenna array antenna units in different resonance frequency bands are not related.

13. The shared-aperture antenna according to claim 9, wherein:

feeding networks of one or more of the microstrip patch antenna units and one or more of the second antenna array antenna units in a same resonance frequency band are related; and feeding networks of one or more of the microstrip patch antenna units and one or more of the second antenna array antenna units in different resonance frequency bands are not related.

14. The shared-aperture antenna according to claim 9, wherein polarization directions of one or more of the microstrip patch antenna units and one or more of the second antenna array antenna unit are the same or orthogonal.

15. The shared-aperture antenna according to claim 9, wherein at least one metamaterial dielectric layer is added on a shared-aperture array of the microstrip antenna array and the second antenna array.

* * * * *